United States Patent [19]

Odagawa

[11] Patent Number: 4,541,582

[45] Date of Patent: Sep. 17, 1985

[54] ROLLED PAPER HOLDER

[75] Inventor: Kazuyoshi Odagawa, Yokohama, Japan

[73] Assignee: Canon Kabushiki Kaisha, Tokyo, Japan

[21] Appl. No.: 444,973

[22] Filed: Nov. 29, 1982

[30] Foreign Application Priority Data

Dec. 11, 1981 [JP] Japan ..... 56-198370

[51] Int. Cl.[4] ..... B65H 19/00

[52] U.S. Cl. ..... 242/55.2; 242/68.4

[58] Field of Search ..... 242/73, 55.2, 55.3, 242/55.53, 55.55, 68.4, 129.51, 129.53; 22/46, 47, 77

[56] References Cited

U.S. PATENT DOCUMENTS

| | | | |
|---|---|---|---|
| 1,815,068 | 7/1931 | Parsons | 242/55.2 |
| 2,052,950 | 9/1936 | Stirrup | 242/55.2 |
| 2,214,097 | 9/1940 | Anderson | 242/55.2 |
| 2,908,449 | 10/1959 | Bolger | 242/68.4 X |
| 4,105,168 | 8/1978 | Rutherford | 242/55.2 |

*Primary Examiner*—Stuart S. Levy
*Assistant Examiner*—David Werner
*Attorney, Agent, or Firm*—Fitzpatrick, Cella, Harper & Scinto

[57] ABSTRACT

One of two mutually engageable portions is mounted on a base and a first rolled paper holding unit is rotatably supported by the base. A second rolled paper holding unit is movable toward the first rolled paper holding unit and is supported by the base to allow rotational movement in a direction substantially perpendicular to the direction of movement toward the first rolled paper holding unit. The second rolled paper holding unit has the other of the mutually engageable means which resiliently engages with the one mutually engageable portion and cooperates with the first rolled paper holding unit to hold a rolled paper.

3 Claims, 6 Drawing Figures

ROLLED PAPER HOLDER

BACKGROUND OF THE INVENTION

1. Field of the Invention

The present invention relates to a rolled paper holder for electronic equipment having a printer.

2. Description of the Prior Art

Most of the electronic equipment with printers use so-called rolled paper as a recording paper. The electronic equipment with printer which uses rolled paper usually has a device for removably and rotatably holding the rolled paper, on the exterior of the main frame. Various rolled paper holders have been proposed and used in the past. They are classified into a first group which accommodates and holds the rolled paper inside the main frame and a second group which holds the rolled paper outside of the main frame. The former is often used in a cash register and a relatively large size electronic desk-top calculator and the latter is often used in a relatively small size office desk-top calculator. In the latter type of rolled paper holder, it is required, from the nature of the electronic equipment on which it is mounted, that the structure be simple and foldable for storage.

FIGS. 1 to 3 show an example of the latter type of rolled paper holder. A construction and a function thereof are explained below. FIG. 1 shows a plan view of the prior art device, FIG. 2 shows a sectional view taken along a line II—II in FIG. 1, and FIG. 3 shows a sectional view taken along a line III—III in FIG. 1. In those figures, numeral 1 denotes an upper external case of an electronic equipment with a printer, numeral 2 denotes a lower external case, numeral 3-1 denotes a rolled paper holding right arm, numeral 3-2 denotes a rolled paper holding left arm, numeral 3-3 denotes rolled paper holding projections, numeral 4 denotes a rolled paper, numeral 5 denotes a tension spring, numeral 6-1 denotes a rolled paper holding right arm shaft, numeral 6-2 denotes a rolled paper holding left arm shaft, numeral 1-1 denotes a rolled paper holding arm spacer of the upper outer case 1, and numerals 6-3 and 6-4 denote engaging portions of the left and right rolled paper holding arm shafts. The rolled paper holding arm shafts 6-1 and 6-2 fixed at right angles to the bottom ends of the rolled paper holding arms 3-1 and 3-2 are hollow cylinders and a predetermined length portion of each of the rolled paper holding arms shafts 6-1 and 6-2 from an end thereof is partially cut away to form a semi-cylindrical and forms the engaging portion 6-3 or 6-4 for the rolled paper holding arm shaft 6-1 or 6-2, respectively. The rolled paper holding arm shafts 6-1 and 6-2 engage with each other at the engaging portions 6-3 and 6-4 to form a perfect cylinder and be coupled to each other. It is rotatably held in a space between the upper outer case 1 and the lower outer case 2. When a force is applied to only one of the rolled paper holding arms 3-1 and 3-2, the left and right rolled paper holding arms 3-1 and 3-2 can be simultaneously rotated in a direction of an arrow shown in FIG. 2. Accordingly, it can be used in a position inclined by 45° from a vertical position or stored in the vertical position as shown by double-dot chain lines. Inside of the rolled paper holding arm shafts 6-1 and 6-2, the tension spring 5 having its opposite ends locked by spring locking pawls 3-4 formed at the bottoms of the rolled paper holding arms 3-1 and 3-2 is provided. By the tension spring 5, the rolled paper holding arms 3-1 and 3-2 are always pulled inwardly to engage with the opposite ends of the rolled paper holding arm spacer 1-1 so that they are held at a spacing to rotatably hold the rolled paper 4. A gap 1-2 is formed behind (left side in FIG. 2) the rolled paper holding left arm 3-2. This, by moving the rolled paper holding left arm 3-2 in a direction of an arrow B shown in FIG. 3 against the tension force of the tension spring 5, the rolled paper 4 can be mounted or removed. In this rolled paper holder, by appropriately selecting the length of the rolled paper holding arm spacer 1-1 of the upper cutter case 1, the rolled papers of different paper widths can be used without modifying the electronic equipment.

However, the prior art rolled paper holder described above has the following disadvantages. The number of parts is large. The work for locking the opposite ends of the tension spring 5 to the spring latching pawls 3-4 of the rolled paper holding arms 3-1 and 3-2 is very troublesome. Thus, part cost and assembly costs are high.

SUMMARY OF THE INVENTION

It is an object of the present invention to provide a rolled paper holder which is simple in structure and easy to assemble.

It is another object of the present invention to hold the rolled paper stably.

It is another object of the present invention to stably hold the rolled paper at a plurality of rotating positions.

It is another object of the present invention to facilitate the mounting and the removal of the rolled paper.

Other objects of the present invention will be apparent from the description of the preferred embodiments of the present invention.

DETAILED DESCRIPTION OF PREFERRED EMBODIMENT

Figure 1:
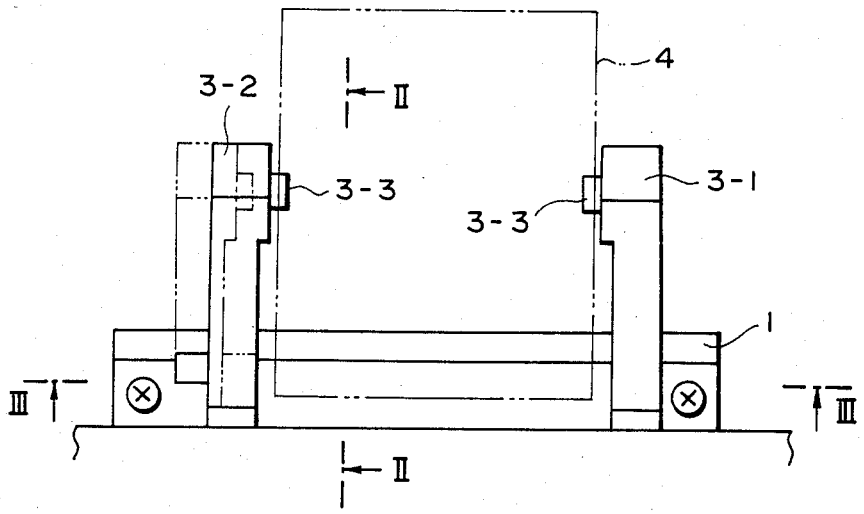
FIG. 1 PRIOR ART
FIG. 1 shows a plan view of an example of a prior art rolled paper holder.
Figure 2:
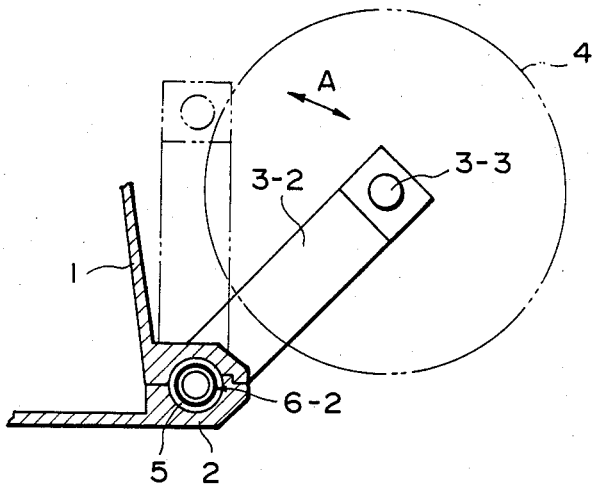
FIG. 2 PRIOR ART
FIG. 2 shows a sectional view taken along a line II—II in FIG. 1.
Figure 3:
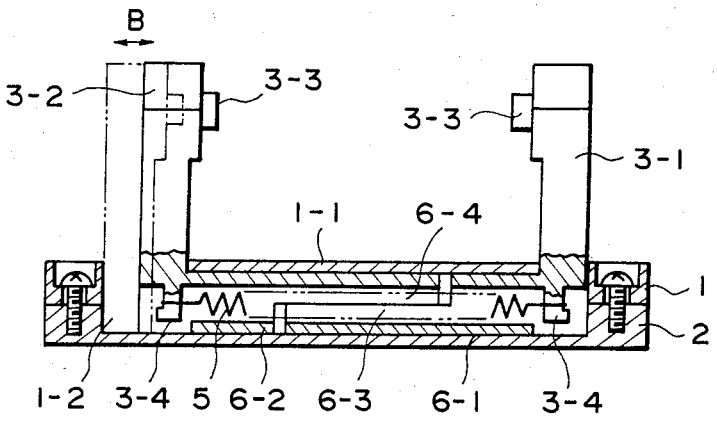
FIG. 3 PRIOR ART
FIG. 3 shows a sectional view taken along a line III—III in FIG. 1.
Figure 4:
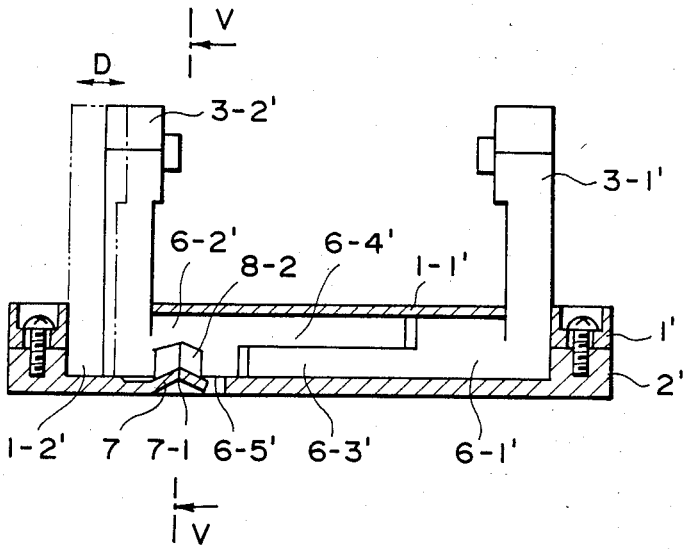
FIG. 4 shows a plan view, partly cut away, of one embodiment of a rolled paper holder of the present invention.
Figure 5:
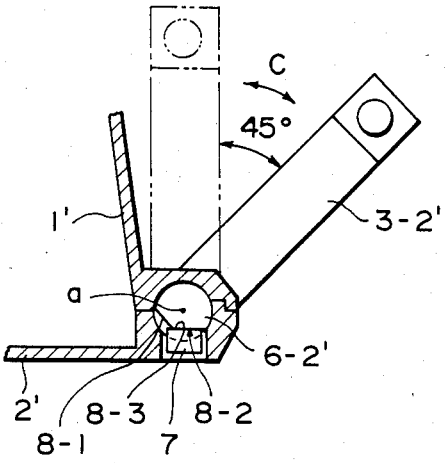
FIG. 5 shows a sectional view taken along a line V—V in FIG. 4.
Figure 6:
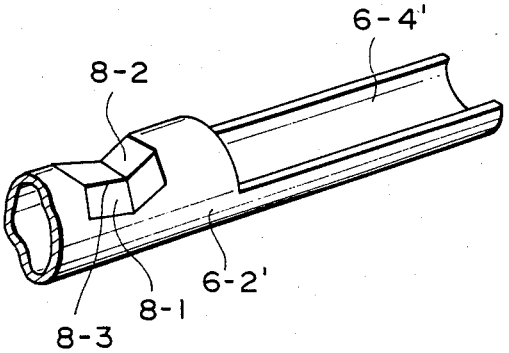
FIG. 6 shows an enlarged perspective view of a rolled paper holding arm shaft portion.

FIG. 4 shows a plan view, partly cut away, of one embodiment of a rolled paper holder of the present invention and FIG. 5 shows a sectional view taken along a line V—V in FIG. 4. Numeral 1' denotes an upper outer case of the electronic equipment with the printer, numeral 1-1' denotes a rolled paper holding arm spacer on the upper outer case 1', numeral 2' denotes a lower outer case, numerals 3-1' and 3-2' denote right and left rolled paper holding arms, numerals 6-1' and 6-2' denote rolled paper holding arm shafts of the rolled paper holding arms 3-1' and 3-2', and numerals 6-3' and 6-4' denote engaging portions of the rolled paper holding arm shafts 6-1' and 6-2', which are rotated as a unit by the engagement in the engaging portions 6-3' and 6-4'. As shown in FIG. 4, an inwardly projecting leaf spring 7 having a V-shaped sectional area is mounted on the lower outer case 2' which is a base to support the rolled paper holding arms 3-1' and 3-2', integrally with the lower outer case 2'. The leaf spring 7 engages with an object to hold it. At a position on the rolled paper holding arm 6-2' which corresponds to the leaf spring 7, two click grooves 8-1 and 8-2 having V-shaped sectional area are formed adjacent to each other so that the leaf spring 7 engages therewith. An enlarged perspective view of a portion of the rolled paper holding arm shaft 6-2' is shown in FIG. 6. The click grooves 8-1 and 8-2 are arranged at an angle of 135° to each other. Numeral 8-3 denotes a boundary for the click grooves 8-1 and 8-2.

When the rolled paper holding arms 3-1' and 3-2' are in a storage position (shown by double-dot chain lines in FIGS. 4 and 5), the leaf spring 7 engages with the click groove 8-1 so that the arms 3-1' and 3-2' are held in the storage position. In order to bring the rolled paper holding arms 3-1' and 3-2' into an operation position, a force is applied rightward in an arrow direction C shown in FIG. 5 to the rolled paper holding arms 3-1' and 3-2' to rotate them. Thus, the boundary 8-3 for the click grooves 8-1 and 8-2 rides on the leaf spring 7 and then the leaf spring 7 engages with the click groove 8-2 so that the operation position in held.

Since the boundary for the click grooves 8-1 and 8-2 is located farther from a center a of the rolled paper holding arm shaft 6-2 than the click grooves 8-1 and 8-2, the leaf spring 7 is flexed when the boundary 8-3 rides over the leaf spring 7. In this manner, the click mechanism is formed. The same operation is carried out when the rolled paper holding arms 3-1' and 3-2' are returned from the operation position to the storage position. It should be understood that the rotation angle of the rolled paper holding arms 3-1' and 3-2' is 45° from the angle (135°) between the click grooves 8-1 and 8-2.

A gap 1-2' is formed behind (left side in FIG. 4) the rolled paper holding arm 3-2' to allow the movement of the rolled paper holding arm 3-2' within a predetermined distance. Thus, by applying a force to the rolled paper holding arm 3-2' in the operation position leftward along an arrow direction D shown in FIG. 4, the apex 7-1 of the leaf spring 7 rides over an end 6-5' of the rolled paper holding arm shaft 6-2' and the leaf spring 7 is flexed so that the rolled paper holding arm 3-2' can be moved into the gap 1-2'. When a force is applied rightward along the arrow direction D, the click groove 8-2 again engages with the leaf spring 7 and the rolled paper holding arm 3-2' is returned to the original position. In this manner, the rolled paper 4 can be mounted in or removed from the space between the rolled paper holding arms 3-1' and 3-2'. When the click grooves 8-1 and 8-2 are in engagement with the leaf spring 7, the rolled paper holding arm 3-2' is held in position by the resilient force of the leaf spring 7 and the spacer 1-1' unless a force higher than a predetermined level is applied to the rolled paper holding arms 3-2'. Accordingly, the rolled paper 4 can be stably held by the rolled paper holding arms 3-1' and 3-2'.

In the present embodiment, like the prior art example described above, the electronic equipment with the printer can use rolled paper of any paper width within a limit of the length of the engaging portions 6-3' and 6-4' of the rolled paper holding arm shafts 6-1' and 6-2' by changing the length of the rolled paper holding arm spacer 1-1' and the position of the leaf spring 7. In the present embodiment the click grooves 8-1 and 8-2 are formed in the rolled paper holding arm 3-2' and the leaf spring 7 and the gap 1-1' are provided. Alternatively, the grooves may be formed in the rolled paper holding arm 3-1', or in both arms 3-1' and 3-2'. The leaf spring 7 may be formed on the rolled paper holding arm 3-2' and the click grooves 8-1 and 8-2 may be formed in the lower outer case 2' which is the base of the equipment. Three or more clock grooves may be formed circumferentially of the rolled paper holding arm shaft or a plurality of click grooves may be formed axially of the rolled paper holding arm shaft.

As described hereinabove, the present invention does not require the tension spring used in the prior art. Thus, the number of parts is reduced and the troublesome assembly work of mounting the tension spring is not necessary. Accordingly, a rolled paper holding of a simpler structure, reduced number of parts and less assembly cost is provided.

What I claim is:

1. A rolled paper holder comprising:

a base having one of two mutually engageable means;

first rolled paper holding means rotatably supported by said base; and second rolled paper holding means movable toward said first rolled paper holding means and supported by said base to allow rotational movement in a direction substantially perpendicular to the direction of movement toward said first rolled paper holding means, said second rolled paper holding means having the other of said mutually engageable means for stopping said second rolled paper holding means at a predetermined position in the direction of movement toward said first rolled paper holding means and at a predetermined rotational position in its rotational direction, said other mutually engageable means being resiliently engaged with said one mutually engageable means when said second rolled paper holding means is moved toward said first rolled paper holding means, said second rolled paper holding means cooperating with said first rolled paper holding means to rotatably hold a rolled paper said mutually engageable means engage with each other at a plurality of rotating positions of said second rolled paper holding means.

2. A rolled paper holder according to claim 1, wherein said first and second rolled paper holding means engage with each other to rotate in unison.

3. A rolled paper holder according to claim 1, wherein when a spacing between said first and second rolled paper holding means is larger than a width of said rolled paper, said mutually engageable means are disengaged from each other.

* * * * *

UNITED STATES PATENT AND TRADEMARK OFFICE

CERTIFICATE OF CORRECTION

PATENT NO. : 4,541,582

DATED : September 17, 1985

INVENTOR(S) : KAZUYOSHI ODAGAWA

It is certified that error appears in the above-identified patent and that said Letters Patent is hereby corrected as shown below:

Col. 2, line 5, change "This" to --Thus--.

Col. 2, line 11, change "cutter" to --outer--.

Col. 3, line 27, change "a" (second occurrence) to --a--.

Col. 4, line 14, change "clock" to --click--.

Signed and Sealed this

Seventh Day of October, 1986

[SEAL]

*Attest:*

DONALD J. QUIGG

*Attesting Officer*

*Commissioner of Patents and Trademarks*